US006516048B2

(12) United States Patent
Mori

(10) Patent No.: US 6,516,048 B2
(45) Date of Patent: Feb. 4, 2003

(54) X-RAY GENERATOR

(75) Inventor: Kuniyoshi Mori, Hamamatsu (JP)

(73) Assignee: Hamamatsu Photonics K.K., Hamamatsu (JP)

( * ) Notice: Subject to any disclaimer, the term of this patent is extended or adjusted under 35 U.S.C. 154(b) by 0 days.

(21) Appl. No.: 10/060,064

(22) Filed: Jan. 31, 2002

(65) Prior Publication Data

US 2002/0154738 A1 Oct. 24, 2002

(30) Foreign Application Priority Data

Feb. 1, 2001 (JP) ..... 2001-025845

(51) Int. Cl.[7] ..... H01J 35/00
(52) U.S. Cl. ..... 378/119; 378/121; 378/34
(58) Field of Search ..... 378/119, 121, 378/34; 376/156; 372/5

(56) References Cited

U.S. PATENT DOCUMENTS 5,426,686 A * 6/1995 Rentzepis et al. ..... 101/467
5,504,796 A * 4/1996 Da Silveira et al. ..... 378/113
6,438,206 B1 * 8/2002 Shinar et al. ..... 378/119
2002/0015473 A1 * 2/2002 Hertz et al. ..... 378/143

FOREIGN PATENT DOCUMENTS

| | | |
|---|---|---|
| JP | 52-142984 | 11/1977 |
| JP | 60-047355 | 3/1985 |
| JP | 61-140041 | 6/1986 |
| JP | 04-012497 | 1/1992 |

* cited by examiner

*Primary Examiner*—Drew A. Dunn
*Assistant Examiner*—Pamela R. Hobden
(74) *Attorney, Agent, or Firm*—Morgan, Lewis & Bockius LLP

(57) ABSTRACT

A voltage control section for controlling a pulsed acceleration voltage applied between a photoelectron releasing layer and an X-ray target in order to accelerate a photoelectron is further provided, so that the acceleration voltage is maintained at a pulse top voltage until the X-ray target is bombarded with the photoelectron after the photoelectron is released from the photoelectron releasing layer. The pulse width of acceleration voltage can be set narrower to such an extent that no discharge occurs, which enables the pulse top voltage to become higher, whereby the energy of pulse X-rays can be made higher by enhancing the speed of photoelectrons.

4 Claims, 2 Drawing Sheets

OPTICAL PULSE OF LIGHT SOURCE
INCIDENT LIGHT PULSE
CONTROL LIGHT PULSE
OPTICAL PULSE OF DELAYED INCIDENT LIGHT
VOLTAGE PULSE OF ACCELERATION VOLTAGE
X-RAY PULSE
REF TIME

X-RAY GENERATOR

BACKGROUND OF THE INVENTION

1. Field of the Invention

The present invention relates to an X-ray Generator for generating pulse X-rays upon optical pumping.

2. Related Background Art

X-rays of high frequency pulses have conventionally been utilized in the field of diagnosing systems, analyzing systems, and the like. While thermoelectron sources are employed as an electron source of an X-ray generating tube for generating the pulse X-rays, the pulse repeating period of X-rays generated thereby is on the order of nanosecond or greater due to restrictions in terms of electronic circuit.

When an optical pumping electron source is employed as the X-ray generating tube, by contrast, the pulse repeating period of generated X-rays can be shortened to the order of picoseconds by pumping with high-frequency pulse light. Such an optical pumping X-ray generating tube is disclosed in Japanese Patent Application Laid-Open No. SHO 52-142984 and No. HEI 4-12497, for example.

SUMMARY OF THE INVENTION

For generating high energy X-rays in an optical pumping X-ray generating tube, it is necessary that an X-ray target be bombarded with photoelectrons at a high speed released from a photocathode. Applying a high voltage between the photoelectron releasing layer and the X-ray target in order to accelerate photoelectrons, however, may be problematic, for example, in that discharge may occur between these electrodes, whereby pulse X-rays may not be generated favorably.

In order to overcome the problems mentioned above, it is an object of the present invention to provide an X-ray Generator which can generate pulse X-rays having a high energy and a high frequency.

This X-ray Generator comprises a light source for emitting pulsed laser light; an X-ray generating tube having a photoelectron releasing layer for releasing a photoelectron in response to the laser light incident thereon, an X-ray target for emitting an X-ray when bombarded with the photoelectron accelerated, and an exit window for emitting the X-ray to the outside; and a voltage control section for controlling a pulsed acceleration voltage applied between the photoelectron releasing layer and the X-ray target in order to accelerate the photoelectron; wherein the acceleration voltage is at a pulse top voltage at least until the X-ray target is bombarded with the photoelectron after the photoelectron is released from the photoelectron releasing layer.

In this configuration, control is effected such that the pulse top voltage (highest voltage of pulse voltage) is applied between both electrodes of the photoelectron releasing layer (cathode) and the X-ray target (anode) at least during the time from the release of a photoelectron to the bombardment therewith, whereby the rising and falling of an acceleration voltage can be set so as to yield such a narrow pulse width that no discharge occurs between the both electrodes. This can raise the pulse top voltage, thereby enabling the photoelectron to attain a higher speed (outputted X-rays to attain higher energy).

The X-ray Generator may further comprise a beam expander for enhancing a spot diameter of the laser light incident on the photoelectron releasing layer. This allows the photoelectron releasing layer to emit a sufficient amount of photoelectrons and can reduce damages to the photoelectron releasing layer.

The X-ray Generator may further comprise dividing means for dividing the laser light from the light source into incident light to be made incident on the photoelectron releasing layer, and control light for controlling the acceleration voltage by way of the voltage control section. This makes it possible to easily acquire a control optical pulse in synchronization with an optical pulse for releasing photoelectrons.

The X-ray Generator may further comprise delay means for delaying the incident light by a predetermined time. This can retard the photoelectron releasing timing by a predetermined time with respect to the rising timing of acceleration voltage.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENT

Figure 1:
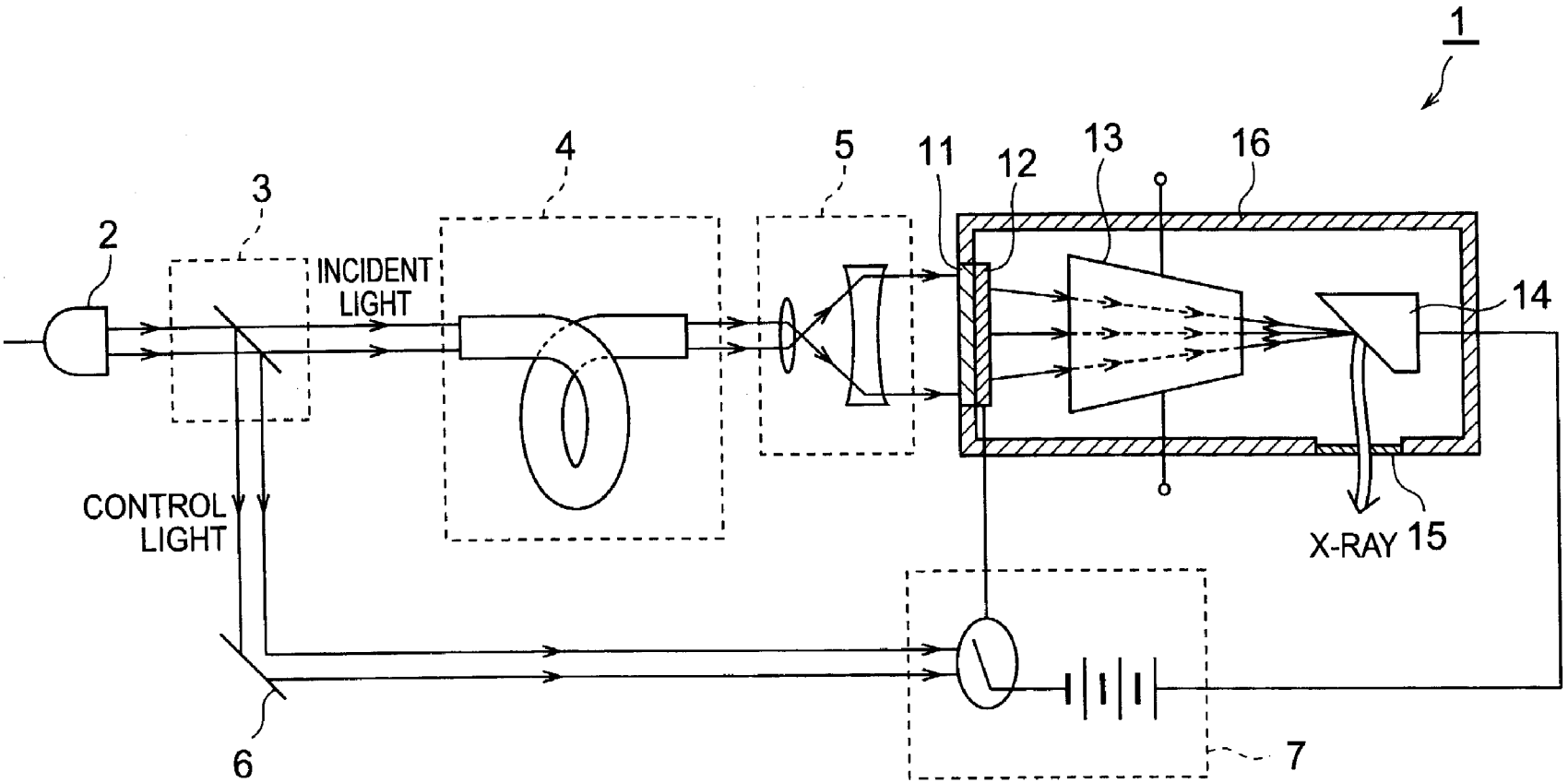
FIG. 1 is a schematic diagram of the X-ray Generator in accordance with an embodiment.

In the following, an embodiment of the present invention will be explained with reference to the accompanying drawings. FIG. 1 is a schematic diagram of the X-ray Generator in accordance with the embodiment.

As depicted, the X-ray Generator of the embodiment comprises an X-ray generating tube 1 of optical pumping type having a photoelectron releasing layer 12 and an X-ray target 14; and a light source 2, such as a laser diode, for generating pulse light. Between the light source 2 and the X-ray generating tube 1, a dividing means 3, a delay means 4, and a beam expander 5 are arranged successively.

The dividing means 3 is constituted by a half mirror or the like, whereas light transmitted therethrough is made incident on the delay means 4, which is constituted by an optical fiber. Arranged on the output side of the delay means 4 is the beam expander 5 constituted by a convex lens and a concave lens. The laser light from the light source 2 having its spot diameter enlarged by the beam expander 5 is made incident on the photoelectron releasing layer 12 formed on the inner face of an entrance window 11 of the X-ray generating tube 1.

On the other hand, the reflected light (control light) from the half mirror (dividing means 3) is configured so as to be reflected by a total reflection mirror 6 and become incident on the light-receiving part of a voltage control section 7. In addition to the light-receiving part, the voltage control section 7 comprises a DC power supply for generating a pulsed acceleration voltage, and switching means for generating a pulsed voltage in response to a signal from the light-receiving part. The pulsed acceleration voltage generated by the voltage control section 7 is applied between the photoelectron releasing layer 12 and X-ray target 14 of the X-ray generating tube 1.

Thus, while the light transmitted through the dividing means 3 is made incident on the X-ray generating tube 1 by way of the delay means 4, the light reflected by the dividing means 3 is fed into the voltage control section 7 by bypassing the delay element and is used for controlling the acceleration voltage of the X-ray generating tube 1, whereby the acceleration voltage can be regulated so as to become a pulse top voltage immediately before the photoelectron releasing timing. Also, since the laser light having its spot diameter enlarged by the beam expander 5 is made incident on the X-ray generating tube 1, a large area of the photoelectron releasing layer 12 can function as an effective photoelectron source, whereby a sufficient amount of photoelectrons can be released, and damages to the photoelectron releasing layer 12 can be reduced.

Here, a vacuum envelope 16 acting as a package for the X-ray generating tube 1 is formed with the entrance window 11 made of glass or the like transparent to the light from the light source 2 and an exit window 15 made of beryllium or the like transparent to X-rays. The inner face of the entrance window 11 is formed with the photoelectron releasing layer 12 made of an alkali metal or antimony, whereas the X-ray target 14 constituted by a metal such as tungsten is disposed within the vacuum envelope 16 so as oppose the photoelectron releasing layer 12. Also, an electron lens 13 for focusing photoelectrons released from a wide area of the photoelectron releasing layer 12 into a single point of the X-ray target 14 is placed between the photoelectron releasing layer 12 and the X-ray target 14.

The pulsed acceleration voltage (output voltage of the voltage control section 7) whose rising timing is regulated by the control light isolated by the dividing means 3 is applied between the photoelectron releasing layer 12 acting as a cathode, and the X-ray target 14 acting as an anode.

Operations of the X-ray Generator shown in FIG. 1 will now be explained with reference to waveform charts of FIGS. 2A to 2D. The abscissa in each of FIGS. 2A to 2D indicates time. The ordinate in FIGS. 2A and 2B indicates optical intensity. The ordinate in FIG. 2C indicates voltage. The ordinate in FIG. 2D indicates X-ray intensity.

Figures 2A, 2B, 2C, 2D:
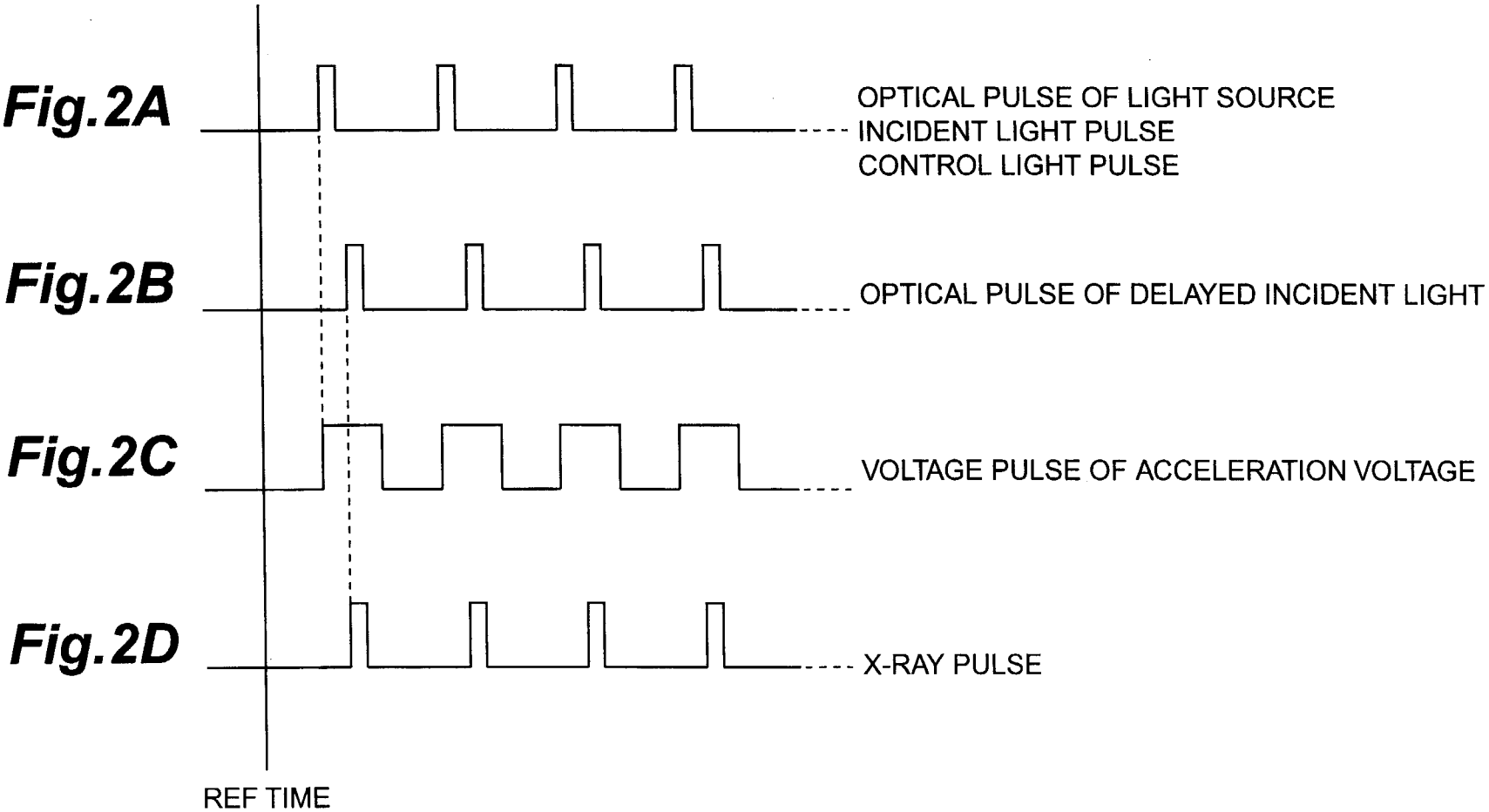
FIGS. 2A, 2B, 2C, and 2D are schematic charts showing modes and timings of respective pulses.

First, each of the waveforms of the incident light (light incident on the photoelectron releasing layer 12) and control light (light incident on the light-receiving part of the voltage control section 7) divided into two by the dividing means 3 after being emitted from the light source 2 is as shown in FIG. 2A. Here, the light transmitted through the dividing means 3 travels by way of the delay means 4, thereby becoming delayed incident light with a delayed timing (see FIG. 2B). In synchronization with the delayed incident light, photoelectrons are released from the photoelectron releasing layer 12.

On the other hand, the control light reflected by the dividing means 3 is made incident on the voltage control section 7 by bypassing the delay element. In synchronization with the rising timing of the control light, a pulsed acceleration voltage (output voltage of the voltage control section 7) rises. If the time constant of a circuit of the voltage control section 7 is set such that the falling timing of acceleration voltage is later than the falling timing of the delayed incident light (see FIG. 2B), its voltage waveform can be regulated so as to maintain a pulse voltage $V_{MAX}$ during a period $T_E$ until the X-ray target 14 is bombarded with a photoelectron after the photoelectron is released from the photoelectron releasing layer 12 as shown in FIG. 2C.

The rising-to-falling time of acceleration voltage (pulse top voltage holding time) $T_V$ is set to a time shorter than the time $T_D$ during which discharge occurs between the photoelectron releasing layer (cathode) 12 and the X-ray target (anode) 14. The time required for discharge to occur (discharge requirement time) $T_D$ is shorter as the voltage between both electrodes is higher, whereby the pulse width $T_V$ of acceleration voltage is required to be made shorter than the discharge requirement time.

As can be seen from FIGS. 2B and 2C, the optical pulse of delayed incident light and the voltage pulse of acceleration voltage are such that the optical pulse of delayed incident light is made incident on the photoelectron releasing layer 12 during when the voltage pulse is at the pulse top voltage. Namely, a high voltage of acceleration voltage has already been applied at the time when the optical pulse of delayed incident light is made incident on the photoelectron releasing layer 1. Therefore, released photoelectrons are gradually accelerated while being converged by the electron lens 13 to which a voltage is applied by a power supply which is not depicted, and then bombard the X-ray target 14.

Since thus accelerated photoelectrons attain increased kinetic energy, they generate X-rays with higher energy than that of conventional X-rays when bombarding the X-ray target 14. The pulse X-rays with high energy are taken out through the exit window 15. The mode of pulse X-rays is shown in FIG. 2D.

Without being restricted to the above-mentioned embodiment, the present invention can be modified in various manners.

For example, the light source 2 is not restricted to the laser diode, and may be light-emitting diodes and solid-state lasers as long as they emit pulsed laser light. Also, the delay means is not restricted to optical fibers having a predetermined length, but may be one in which prisms and reflecting mirrors are combined together so as to elongate the optical path to the photoelectron releasing layer 12. Materials, forms, and positional relationships of the photoelectron layer 12, X-ray target 14, exit window 15, and the like may be changed appropriately as long as the X-ray generating tube 1 is of optical pumping type.

The optical pulse of incident light and the voltage pulse may be synchronized with each other not only by a method utilizing the same optical pulse with the aid of dividing means 3 such as a half mirror, but also by a method in which the voltage pulse of the power supply of the light source 2 is divided into two, which are fed into the light source 2 and the voltage control section 7, respectively, so as to attain synchronization, for example, as long as they are methods in which rising timings are in synchronization with each other.

Further, in addition to the pulse voltage, the voltage control section 7 may apply a predetermined positive bias voltage not higher than an allowable voltage at which no discharge occurs. In this case, the pulse rising time and pulse falling time of the voltage pulse are shortened, whereby an acceleration voltage at a higher voltage can be applied as well.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. An X-ray Generator comprising:

a light source for emitting pulsed laser light;

an X-ray generating tube having a photoelectron releasing layer for releasing a photoelectron in response to said laser light incident thereon, an X-ray target for emitting an X-ray when bombarded with said photoelectron accelerated, and an exit window for emitting said X-ray to the outside; and a voltage control section for controlling a pulsed acceleration voltage applied between said photoelectron releasing layer and said X-ray target in order to accelerate said photoelectron;

wherein said acceleration voltage is at a pulse top voltage at least until said X-ray target is bombarded with said photoelectron after said photoelectron is released from said photoelectron releasing layer.

2. An X-ray Generator according to claim 1, further comprising a beam expander for enhancing a spot diameter of said laser light incident on said photoelectron releasing layer.

3. An X-ray Generator according to claim 1, further comprising dividing means for dividing said laser light from said light source into incident light to be made incident on said photoelectron releasing layer, and control light for controlling said acceleration voltage by way of said voltage control section.

4. An X-ray Generator according to claim 1, further comprising delay means for delaying said incident light by a predetermined time.

* * * * *